United States Patent [19]

Hoffman

[11] 4,183,124

[45] Jan. 15, 1980

[54] METHOD OF AND APPARATUS FOR FABRICATING SPIRAL WRAPPED CARTRIDGE CASES

[75] Inventor: Robert F. Hoffman, Ballwin, Mo.

[73] Assignee: Kisco Company, St. Louis, Mo.

[21] Appl. No.: 853,047

[22] Filed: Nov. 21, 1977

[51] Int. Cl.[2] ..... B21K 21/04; B21D 51/54; B23P 15/22

[52] U.S. Cl. ..... 29/1.3; 60/560; 264/314; 72/370

[58] Field of Search ..... 72/62, 61, 58, 370; 264/314, DIG. 50; 29/1.3; 60/560; 425/389, 500, 525, DIG. 19

[56] References Cited

U.S. PATENT DOCUMENTS

| | | | |
|---|---|---|---|
| 381,242 | 4/1888 | Hobson | 72/62 |
| 2,787,973 | 4/1957 | Heidmann | 113/44 |
| 2,827,766 | 3/1958 | Hufford | 60/560 |
| 3,005,431 | 10/1961 | Möller | 113/44 |
| 3,043,254 | 7/1962 | Heidmann | 72/24 |
| 3,290,919 | 12/1966 | Malinak et al. | 72/453.05 |
| 3,635,061 | 1/1972 | Rydell | 72/63 |
| 3,910,087 | 10/1975 | Jones | 72/63 |
| 4,006,619 | 2/1977 | Anderson | 72/58 X |
| 4,055,063 | 10/1977 | Krips et al. | 72/62 |

FOREIGN PATENT DOCUMENTS

| | | | |
|---|---|---|---|
| 1052077 | 3/1952 | France | 29/1.3 |
| 574966 | 1/1946 | United Kingdom | 29/1.3 |

*Primary Examiner*—Horace M. Culver
*Attorney, Agent, or Firm*—Koenig, Senniger, Powers and Leavitt

[57] ABSTRACT

Method of and apparatus for fabricating spiral wrapped cartridge cases or the like, in which an expandable bladder positioned within the interior of the cartridge case is initially expanded by application of hydraulic fluid at relatively low hydraulic pressure levels and at relatively high flow rates until the bladder substantially fills the cartridge case and then is pressurized at relatively high hydraulic pressure levels to form the cartridge case within a die cavity. Hydraulic pressure is applied to the bladder by a hydraulic pressure generator which is powered solely by the closure of the platens of a conventional industrial press between which the die and the pressure generator are mounted. The pressure generator shifts automatically from its low pressure to its high pressure mode of operation as the press platens close.

5 Claims, 6 Drawing Figures

77
81
31
27
84
83
101
101
103
80
65
79
45
49
41
61
43
47
35
59
63
29
39
55
37
57
95
97
92
53
93
33
51
69
89
99
91
87
85
71

METHOD OF AND APPARATUS FOR FABRICATING SPIRAL WRAPPED CARTRIDGE CASES

BACKGROUND OF THE INVENTION

This invention relates to a method of fabricating spiral wrapped cartridge cases, and more particularly to such a method for fabricating necked-down spiral wrapped cartridge cases.

As is conventional, cartridge cases for certain types of artillary rounds are often made of spiral wrapped construction. More specifically, a spiral wrapped cartridge case typically comprises a solid metal base and a generally cylindric or tapered body rolled from a single sheet of flat sheet metal. The body may be secured to the base in any number of ways. For example, the base may have a circular groove in its inner face and one end of the body may have an inwardly projecting lip formed thereon. A circular collar is fitted within the groove in the base so that a portion of the collar overlies the inwardly extending lip of the body. Upon forming the case within the die, a special tool exerts an axial force on the collar which deforms the collar and locks it in position on the base and deforms it so it positively grips and secures the body lip. In other spiral wrapped cartridge cases, the body may be secured to the base before the body is inserted into the die.

Regardless of the manner in which the body is secured to the base, present day spiral wrapped cartridge cases are typically formed by placing the base and the body into a die cavity. A forming member of solid elastomeric or plastic material (e.g., urethane plastic or the like) is inserted into the body from the open mouth thereof. Axial compression loading is applied to the forming member by a hydraulic ram or the like thus forcing the forming member into the interior of the body and axially compressing the forming member so as to cause it to expand radially thereby to force the body into conformance with the die. The forming pressure exerted by the forming member on the body is of sufficient magnitude (e.g., about 12,000–17,000 psi) so as to form the body generally to the shape of the die and to cause the overlapping edges of the sheet metal body to interlock thus forming a substantially rigid cartridge case. In the fabrication of some configurations of spiral wrapped cartridge cases, a collar forming tool is carried by the forming member so as to exert axial loading on the locking collar to deform it into the base groove and to secure the body lip to the base cap simultaneously with forming the body.

Spiral wrapped cartridge cases have been proven to be highly successful in field and combat use and are much less expensive to manufacture than, for example, drawn brass or steel cartridge cases. Over the years, millions of these spiral wound cartridge cases have been manufactured and used in combat. However, the use of spiral wrapped cartridge cases has been limited to cartridge cases, such as for 105 mm. howitzer and for five-inch naval guns, which are generally cylindrical (they may have a slight taper along their length) or which have a neck nearly the same diameter as the main body of the case. However, in attempting to produce spiral wrapped cartridge cases having a neck diameter substantially less than the diameter of the main body of the case or in attempting to manufacture cartridge cases having a relatively high degree of taper, the above-described manufacturing process for spiral wrapped cartridge cases utilizing a solid elastomeric forming member is not suitable because it is not possible to insert a sufficient quantity of the forming member into the interior of the body through the relatively narrow neck of the case so as to sufficiently fill the body and to apply the required radially outward forming force to the body.

In the 1950's, a process was developed in France by Mr. Leon Heidmann for forming cartridge cases in which an expandable bladder or sack was inserted into the open mouth of the cartridge case and was then pressurized to high pressure levels by hydraulic fluid. As shown in U.S. Pat. Nos. 2,787,973 and 3,043,254, Mr. Heidmann generated high hydraulic pressure levels by dropping a heavy weight onto a piston movable within the cylinder thereby to instantaneously compress the hydraulic fluid within the cylinder to the desired pressure level.

Reference may also be made to such U.S. Pat. Nos. as 381,242, 3,005,431, 3,290,919, 3,635,061 and 3,910,087 which disclose various metal forming processes in which a metal part is formed by means of hydraulic pressure forcing the part outwardly within a die cavity.

SUMMARY OF THE INVENTION

Among the several objects and features of this invention may be noted the provision of a method of fabricating spiral wrapped cartridge cases or the like and especially for fabricating such cartridge cases which have a cartridge case neck of substantially smaller diameter than the main body of the cartridge case or which have a high degree of taper; the provision of such a method which utilizes a conventional industrial press to generate the high hydraulic pressures required for forming a cartridge case in a die cavity; and the provision of such a method which produces spiral wrapped cartridge cases at production rates.

Briefly, the method of this invention involves fabricating spiral wrapped cartridge cases having a base and a body. The body is made of a spirally wrapped sheet metal plate having its margins at least partially overlapped with one end of the body securable to the base and the other end of the body being open and constituting the mouth of the cartridge case. The method involves inserting the base and the body of the cartridge case into a die. An expandable bladder is then positioned in the body through the mouth thereof with the bladder in direct communication with means for applying hydraulic pressure thereto. The die and the hydraulic pressure applying means are then moved relative to one another for generating hydraulic pressure levels within the bladder sufficient to form the body within the die.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
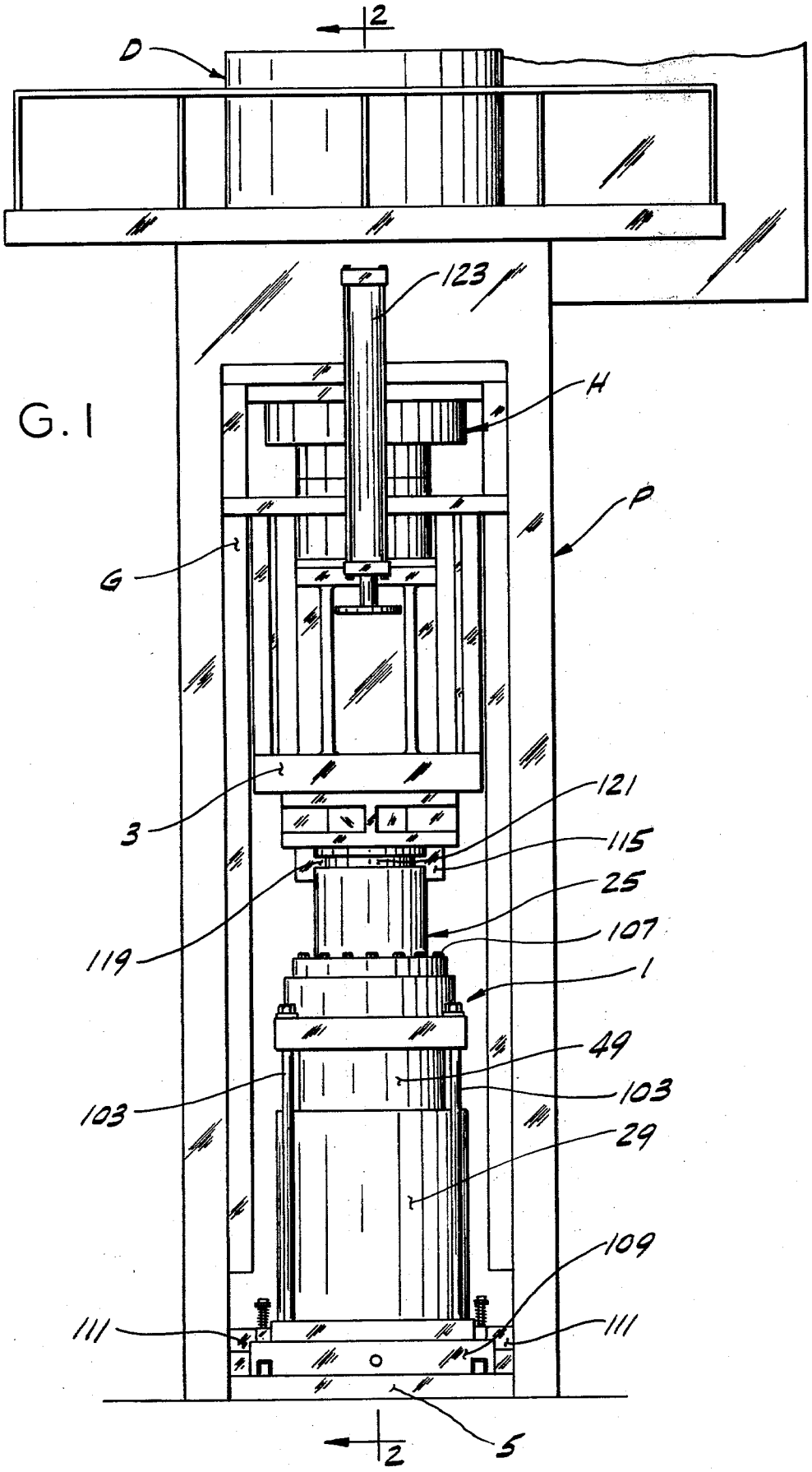
FIG. 1 is a front elevational view of a conventional industrial hydraulic press with its platens open and with apparatus for carrying out invention installed therebetween.
Figure 2:
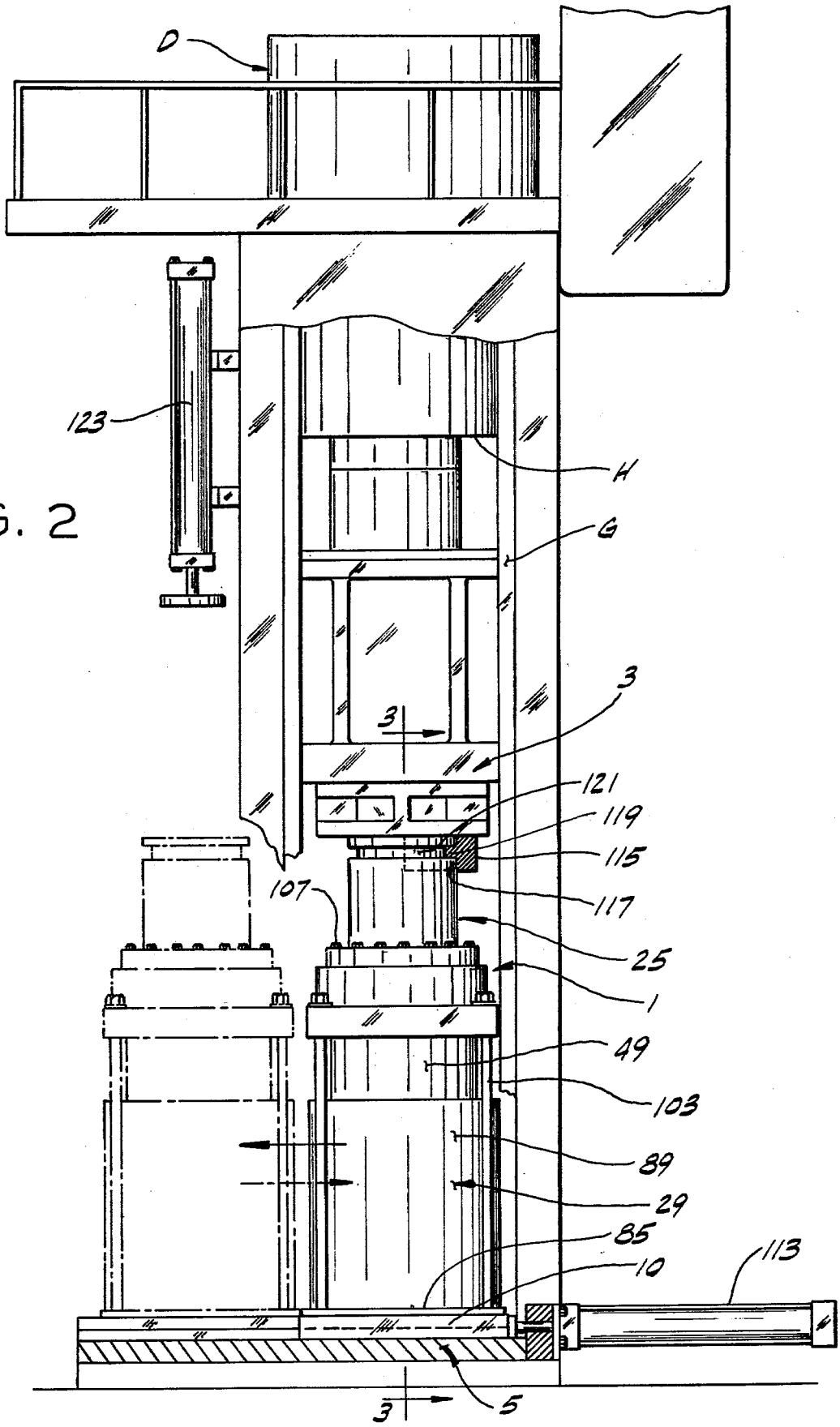
FIG. 2 is a vertical cross-sectional view of a portion of the press taken along line 2—2 of FIG. 1 showing the apparatus mounted on a carriage for horizontal movement between an operating position (as shown in solid lines) between the platens of the press in which a cartridge case may be formed in the apparatus and a retracted loading-unloading position (shown in phantom) in which a completed cartridge case may be removed from the apparatus and in which an unformed cartridge case body and base may be loaded into the apparatus.
Figure 3:
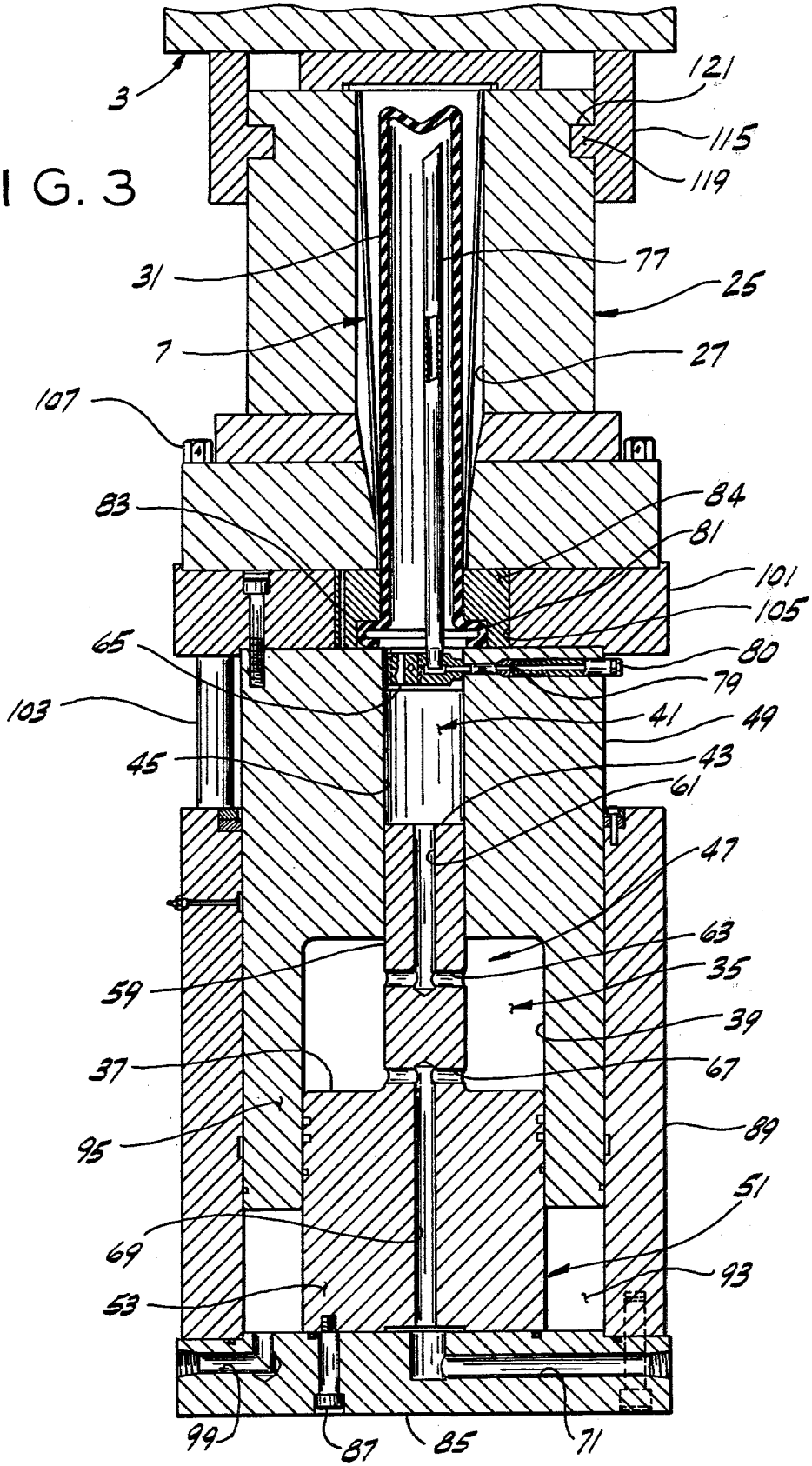
FIG. 3 is an enlarged vertical cross-sectional view of the apparatus taken along line 3—3 of FIG. 2 showing a die, a cartridge case body and base within the die, an expandable bladder within the cartridge body, a pressure generator powered solely by the closure of the platens of the press for generating and supplying hydraulic pressure to the bladder at pressure levels necessary to form the cartridge case body within the die.

Referring now to FIGS. 1–3 of the drawings, apparatus for carrying out this invention, indicated in its entirety at 1, is shown (in solid lines) in its operating position in which it is positioned between the movable upper platen 3 and the fixed lower platen 5 of a conventional, hydraulically driven press P. Press P may be any conventional large industrial press, such as a model 400-HD-142T press made by Verson All-Steel Press Company of Chicago, Ill. As shown in FIG. 1, press P includes a hydraulic ram H and a hydraulic drive D including an electric motor and hydraulic pump for pressurizing the ram so as to forceably drive upper platen 3 toward lower platen 5. Upper platen 3 is slidable along gibs G of the press frame toward and away from the lower platen.

Figure 6:
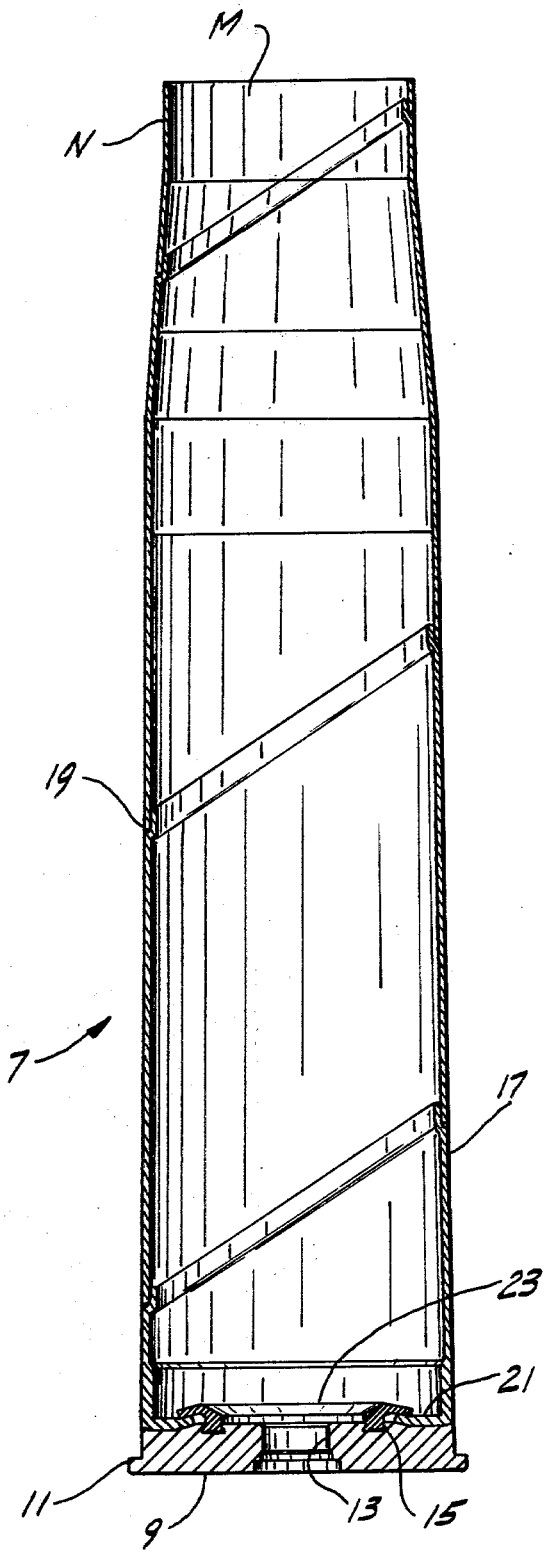
FIG. 6 is a longitudinal cross-sectional view of a spiral wrapped cartridge case.

Apparatus 1 is particularly well-suited for the fabrication of spiral wrapped cartridge cases, such as is generally indicated at 7 in FIG. 3, and as is shown in detail in FIG. 6. More particularly, cartridge case 7 includes a solid metal, machined base 9 having an outer flange 11 therearound, a center primer opening 13, and a circular or annular groove 15 on its inner face. The cartridge case further includes a spiral wrapped body 17 which is rolled from a single sheet metal plate rolled or wrapped in spiral fashion to form a hollow, generally cylindric or tapered tubular body. As indicated at 19 in FIG. 6, the edges of the plate at least partially overlap and the ends of the plate at one end of the body are bent inwardly to form an inwardly projecting lip 21. The outer end of the body is open and constitutes a mouth M for the cartridge case. A circular collar 23 is fitted in groove 15 in the base and a portion of the collar overlies lip 21. Prior to loading the body and the base into the apparatus 1 for forming, a locking tool (not shown) applies a force to collar 23 so as to cause the collar to be bent down on the body lip 21 thereby to lock or otherwise secure the body to the base and to secure the collar within groove 15.

During forming, body 17 is expanded outwardly upon application of relatively high internal pressures (for example, pressures ranging between about 15,000–20,000 psi) so that the body is forced outwardly to conform to the shape of a die cavity and so that the overlapped margins of the body conform to one another thus becoming interlocked. In this manner, the body is accurately formed to contain a predetermined amount of propellant and the neck N of the cartridge case is formed to precisely receive the base of a projectile (not shown).

Apparatus 1 comprises a cylindric die, as generally indicated at 25, having a die cavity 27 therewithin in which cartridge case 7 is formed. The die, when in its operating position, is positioned beneath and is movable with upper platen 3 of press P toward and away from lower platen 5. A hydraulic pressure generating unit, as generally indicated at 29, is positioned on lower platen 5 when the apparatus is in its operating position for applying the above-mentioned forming forces to a cartridge case in body 17 and die cavity 27. This pressure generator includes an expandable bladder 31 of a suitable elastomeric material, such as polyurethane or the like, which is adapted to be positioned in open mouth M of a cartridge case body in die cavity 27. The hydraulic pressure generator has a low pressure and a high pressure stage or mode of operation for supplying hydraulic pressure to the bladder. The generator is powered solely by the movement of platens 3 and 5 of press P toward one another. Pressure generator 29 includes a first cylinder and piston arrangement, as is generally indicated at 35, including a first piston 37 sealably, slidable within a first cylinder 39 upon closure of the platens of press P for pressurizing hydraulic fluid or oil within the first cylinder at a relatively low pressure level and at a relatively high flow rate so as to flow into the interior of bladder 31 thereby to rapidly cause the bladder to expand so as to substantially fill the interior of body 17. Pressure generator 29 further includes a second cylinder and piston arrangement, as generally indicated at 41, including a second piston 43 sealably slidable within a second cylinder 45 upon closure of the platens of the press thereby to pressurize hydraulic fluid within the second cylinder at a relatively high pressure level and at a relatively slow flow rate for pressurizing bladder 31 so that it exerts the desired forming forces upon the cartridge case body within the die cavity. As shown in FIG. 3, the working area of first piston 37 is considerably larger than the working area of second piston 43. For example, the working area of the first piston may be about 6–12 times the working area of the second piston. In accordance with this invention, means, as generally indicated at 47, is provided for automatically shifting pressure generator 29 after bladder 31 has been sufficiently expanded so as to substantially fill body 17 from its low pressure to its high pressure mode of operation while platens 3 and 5 of press P continue to close without pause in the closure of the press platens.

Figure 4:
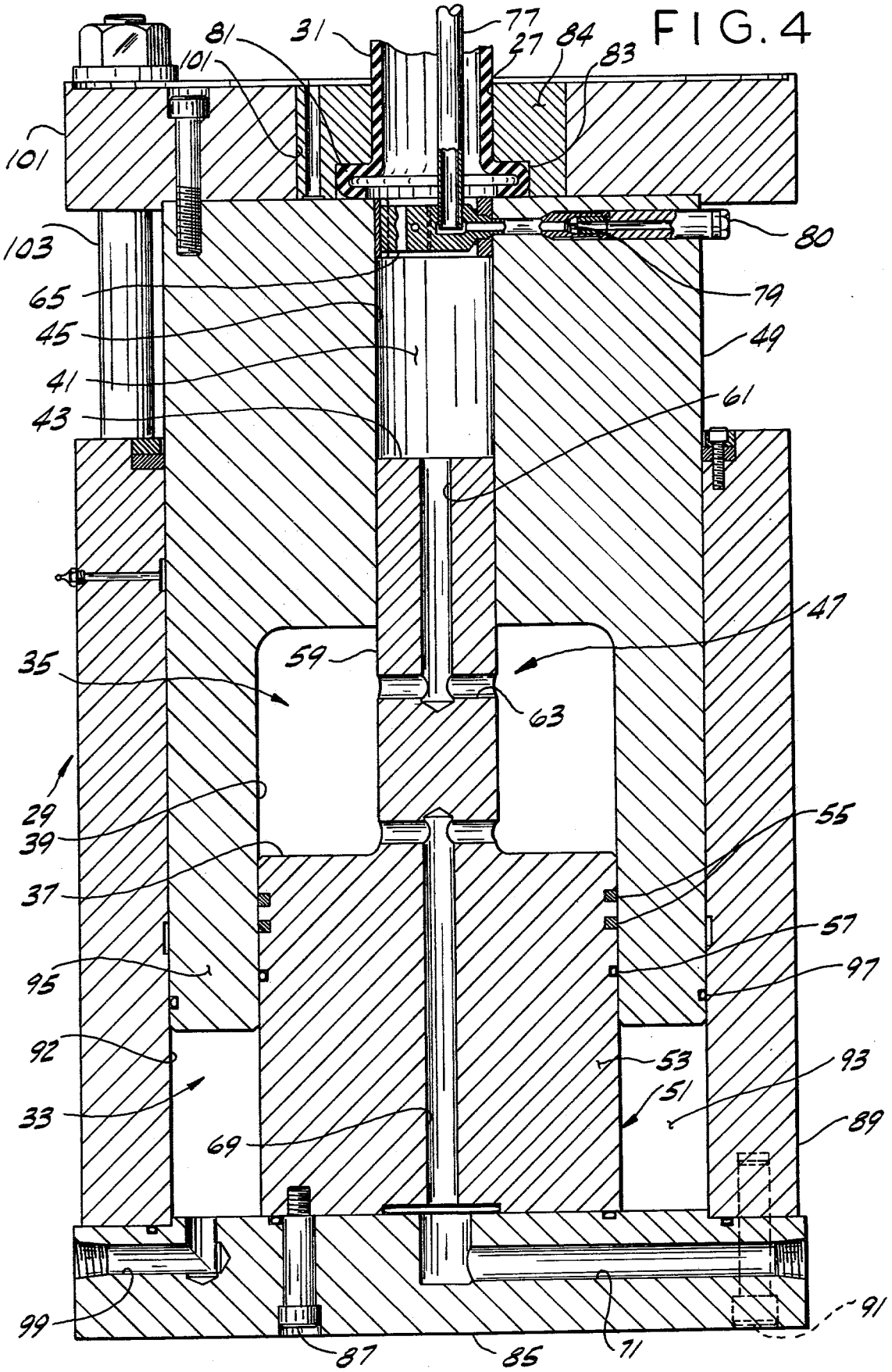
FIG. 4 is an enlarged cross-sectional view of the pressure generator.

As best shown in FIG. 4, pressure generator 29 further comprises a cylinder block 49 of circular cross-section carried by die 25 and movable with upper platen 3 of press P when the apparatus is in its operating position, and a cylindric piston member 51 supported by the lower platen 5. Cylinder block 49 has first cylinder 39 and second cylinder 45 therewithin, these cylinders being coaxial. Piston member 51 includes a base portion 53 which constitutes first piston 37 and which is slidably received within first cylinder 39. A pair of piston rings 55 and an O-ring seal 57 carried by the base portion seal the base portion relative to first cylinder 39. The piston member has a coaxial extension 59 extending endwise from the face of first piston 37, this extension being slidably received in second cylinder 45. Preferably, the sides of the extension are precision ground and the inner walls of the second cylinder are honed so that the extension is slidably received in the second cylinder in leak-tight fashion even at high hydraulic pressure levels. The end of this extension thus constitutes face of piston 43. As shown in FIGS. 3 and 4, die 25, cylinder block 49, and piston member 51 are of circular cross-section and all unnecessary grooves, extensions, and other stress users have been eliminated so as to minimize stress concentrations therein. Further, it will be understood that the working area of the first piston includes the working area of the second piston.

As shown in FIG. 4, extension 59 has a blind axial bore 61 therein which is intersected by a crossbore 63 thereby to provide communication between first cylinder 39 and second cylinder 45 when cylinder block 49 is in its illustrated position in its low pressure mode of operation. Of course, second cylinder 45 is in direct communication with the interior of bladder 31 via an opening 65 and thus both the first and second cylinders 39 and 41, respectively, are in direct communication with the bladder when crossbore 63 is unblocked by cylinder block 49 so that hydraulic fluid compressed within both the first and second cylinders upon closure of the platens of press P is pressurized to the same level and is admitted into the bladder. By direct communication, it is meant that hydraulic working fluid is communicated from the first and second cylinders without having to flow through any lines, piping, fittings, valves or the like exteriorly of pressure generator 29. By providing a direct connection of the first and second cylinders to bladder 31, it will be appreciated that a major source of hydraulic leaks and other malfunctions are eliminated by the apparatus of this invention.

In the low pressure mode of operation of pressure generator 29 during an initial portion of the closing motion of the platens, crossbore 63 is unblocked and hydraulic fluid at relatively high flow rates and low hydraulic pressure levels (e.g., 2,000 psi) flows directly into bladder 31. As cylinder block 49 and piston member 51 move toward one another during a subsequent portion of the closing motion of the platens, crossbore 63 will become blocked by the cylinder block thus blocking communication between first cylinder 39 and bladder 31. Hydraulic fluid from within first cylinder 39 is vented to a reservoir R (see FIG. 5) by a second crossbore 67 in piston extension 59 and a central bore 69 in piston member 51. A bore 71 in the base of the piston member and a hydraulic unloading circuit, as generally indicated at 73, connects the interior of first cylinder 39 to hydraulic reservoir R.

Figure 5:
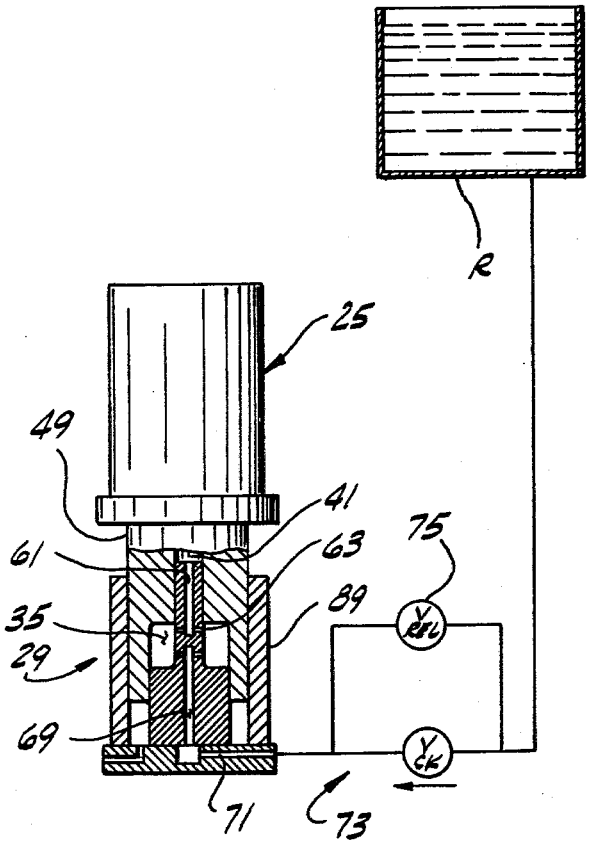
FIG. 5 is a semi-diagrammatic view of the apparatus of this invention illustrating the hydraulic circuitry of the apparatus.

The above-mentioned hydraulic unloader circuit 73 includes a hydraulic pressure relief or unloading valve 75, such as a model B0810A1 commercially available from the Double A Products Company of Manchester, Mich. which may be selectively set to release pressure from within the first cylinder 39 in the event pressure therewith exceeds a predetermined pressure level (referred to as the set pressure) and to return hydraulic fluid from the first cylinder to reservoir R as press platens 3 and 5 continue to close. For example, relief valve 75 may be set to relieve pressure from within the first cylinder at a pressure of about 2,000 psi. Thus, as platens 3 and 5 of press P close thus causing cylinder block 49 and piston member 51 to move toward one another with crossbore 63 unblocked (that is, during the initial portion of the closing motion of the platens when pressure generator 29 is in its low pressure mode of operation), hydraulic fluid in both the first and second cylinders is forced into bladder 31 at a relatively high flow rate thereby to rapidly inflate the bladder so that it substantially fills the interior of the body 17 within die cavity 27. As the cylinder block and piston member continue to move toward one another and as the bladder becomes fully inflated, the pressure within the pressure generator will increase. When the pressure rises above the set pressure of relief valve 75 (for example, 2,000 psi), the unloading valve will release pressure from the first cylinder. Crossbore 63 is so positioned along the length of extension 59 that the crossbore is blocked by cylinder block 49 just prior to or contemporaneous with the time bladder 31 becomes fully inflated (i.e., at the beginning of the subsequent portion of closing motion of the platens). Thus, upon tripping of relief valve 75, hydraulic pressure from within first cylinder 39 is released and the hydraulic fluid therewithin is free to flow into reservoir R via the unloading valve. With second cylinder 45 blocked off from the first cylinder and with the latter now vented due to the opening of relief valve 75, the full force of press P (which may be as much as 400 tons) will now be exerted against the relatively small working area of second piston 43 thereby generating very high hydraulic pressure levels within the second cylinder 45 and within bladder 31. By way of example, the forming pressures generated during the high pressure mode of operation may be about 6–12 the maximum pressure generated in the low pressure mode. Because the platens of press P may tend to move toward one another at a substantially constant speed regardless of load, the rapid inflation of bladder 31 while the apparatus is in its low pressure mode of operation greatly speeds up the cycle time required to form a cartridge case. It will be understood that pressure generator 29 will automatically shift from its low to its high pressure mode of operation as the platens of press P close without pause in the closing movement of the press. Upon opening platens 3 and 5, pressure within bladder 31 is relieved, thereby contracting the bladder 31 so as to permit removal of the completed cartridge case from the die. As is shown in FIG. 5, hydraulic fluid reservoir R is preferably positioned above the level of pressure generator 29 so that upon opening of platens 3 and 5, hydraulic fluid will readily flow into the first cylinder.

As shown in FIG. 3, a relief tube 77 extends into bladder 31 and it leads to a safety pressure relief burst disk 79. The latter is selected to burst upon the pressure within the bladder exceeding a maximum pressure level (for example, at a pressure somewhat above 20,000 psi) so as to relieve pressure from within the bladder via a vent 80. As heretofore mentioned, bladder 31 is an expandable bladder preferably of molded polyurethane elastomeric material or the like. The base of the bladder extends out and doubles back on itself to form a U-shaped flange 81 (as shown in FIG. 4) which fits into a groove 83 in a securement ring 84. The inner walls of flange 81 of the bladder are exposed to pressurized hydraulic fluid within the bladder so that upon the bladder being pressurized the flange is forced outwardly into sealing engagement with the walls of securement ring 84 and with cylinder block 49. Thus, this flange 81 constitutes a pressure actuated seal for the bladder which effectively seals against high hydraulic pressure levels within the bladder and which effectively seals the bladder relative to the cylinder block and to the die.

In FIG. 4, piston member 51 is shown to be secured to a base plate 85 by means of bolts 87. A cylindrical housing 89 is sealingly secured to the base plate by bolts 91. Housing 89 is concentric with respect to piston member 51 and its inner wall 92 is spaced from the outer surface of base portion 53 thereby to define an annular space 93. Cylinder block 49 has a cylindrical skirt 95 which extends downwardly and which is slidably, sealably received in annular space 93. As heretofore mentioned, piston rings 55 and O-ring seal 57 seal first piston 37 with respect to the inner face of cylinder block skirt 95. An O-ring 97 carried on the outer face of the skirt seals the latter with respect to the inner wall 92 of housing 89. A port 99 in base plate 85 in communication with annular space 93 is adapted to be connected to a source of pressurized fluid (such as compressed air or hydraulic fluid under pressure) and to admit the pressurized fluid into annular space 93 thereby to exert a force on cylinder block 49 and die 25 which moves the cylinder block and die upwardly relative to the piston member.

As shown in FIGS. 3 and 4, die 25 and cylinder block 49 are rigidly secured to a head plate 101, the latter being vertically movable on four guide bolts 103 relative to base 85 and to piston member 51. The guide bolts are secured to base plate 85. Head plate 101 has a central opening 105 therein for reception of securement ring 84. Die 25 overlies ring 84 and holds the ring captive within central opening 105. The die is fixedly secured to head plate 101 by bolts 107. Thus, bladder 31 extends through ring 84 and into die cavity 27. It will be readily appreciated that a feature of apparatus 1 is that die 25 and bladder 31 may be rapidly changed by unbolting bolts 107, removing the die from head plate 101, and by lifting securement ring 84 from opening 105 in the head plate. Because hydraulic pressure from within the bladder seals flange 81 as heretofore described, the bladder self-seals on cylinder block 49 and on securement ring 84 and no other seals are required for the bladder. Die 25 and cylinder block 49 are movable vertically together as a unit with respect to piston member 51 and to base plate 85. The pressurized fluid admitted into annular space 93 acts on the cylinder block to lift the cylinder block and the die relative to the piston member and base 81.

Apparatus 1, including base 85, piston member 51, cylinder block 49, and die 25, is mounted on a carriage 109 slidably movable in horizontal direction between an operating position in which the die is located below upper platen 3 of press P in position for forming of a cartridge case (shown in solid lines in FIG. 2) and a retracted or unloading position (as shown in phantom in FIG. 2) in which the upper end of the die is readily accessible for unloading a formed cartridge case from the die and for loading an unformed body 17 with a base 9 secured thereto into the die. Carriage 109 is movable along a track 111 in horizontal direction between its operating and retracted positions by a hydraulic cylinder 113. Upper platen 3 of press P carries a die receiving head 115 for closing the upper end of die 25 and for connecting the die to the upper platen of press P when the apparatus 1 is in its operating position. Head 115 includes a socket 117 open at one side thereof toward die 25 and having a part-circular internal flange 119 which fits into a circumferential groove 121 around the top of the die. Thus, as die 25 moves horizontally from its retracted position toward its operating position, the upper end of the die will move into socket 117 and flange 119 will fit into groove 121. With the die fully in its operating position, head 115 bears against the top of the die and forces the die and cylinder block 49 downwardly upon closure of the platens of press P. Upon opening of the press platens, flange 119 in engagement with groove 121 lifts the die, head plate 101, and cylinder block 49 relative to base plate 85 and piston member 51.

A hydraulic ram 123 is shown to be mounted on press P above the position of die 25 when the latter is in its retracted or unloading position. Ram 123 is adapted to be readily connected to a formed cartridge case in die cavity 27 to aid in removal of the cartridge case from the die. It will be understood that suitable work platforms and cartridge case storage racks may be provided at convenient locations above track 111 for accommodating workmen and supplies for the apparatus.

The method of this invention is preferably, but not necessarily, practiced in conjunction with apparatus 1 heretofore described and the method involves inserting a body 17 with a base 9 secured thereto into die 25 while apparatus 1 is in its retracted or unloading position. Expandable bladder 31 is positioned within the body through mouth M thereof and the bladder is in direct communication with means for applying hydraulic pressure thereto (e.g., with hydraulic pressure generator 29). The apparatus is then moved into its operation position between platens 3 and 5 of press P. Upon energizing the press to close its platens, the die and the hydraulic pressure applying means are moved toward one another for initially generating hydraulic pressure within the bladder at relatively low pressure and high flow rate to fully inflate the bladder within body 17 and then at a lower flow rate and at high pressure sufficient to form the body within the die.

It will be understood that the method of this invention contemplates forming any spiral wrapped cartridge cases or other articles having one or more sheet metal plates rolled to form the body.

In view of the above, it will be seen that the several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

What is claimed is:

1. A method of fabricating spiral wrapped cartridge cases or the like each of which includes a base and a hollow body made of spirally wrapped sheet metal with the margins of the sheet metal at least partially overlapped, one end of said body being securable to the base and the other end of the body being open and constituting a mouth for the cartridge case, said method comprising:

placing a base and a body in a cavity in a die, the cavity being shaped to form the body into the desired shape for the cartridge casing or the like by expansion of the body, said die being part of an assembly comprising an expandable bladder in the cavity and a hydraulic pressure generator adapted to deliver hydraulic fluid under pressure to the bladder for expanding it on compression of said assembly;

the body being positioned for expansion of the bladder therein;

positioning said assembly with the base and body in the die in a press between platens of the press;

closing the platens to effect compression of said assembly for delivery of hydraulic fluid under pressure to the bladder to expand it for forming the body in the die;

during an initial portion of the closing motion of the platens, delivering hydraulic fluid from the hydraulic pressure generator at a relatively low hydraulic pressure level and at a relatively high flow rate to said bladder to expand said bladder into engagement with the body, in response to the closing of the platens;

during a subsequent portion of the closing motion of the platens, delivering hydraulic fluid from the hydraulic pressure generator at a relatively high hydraulic pressure level and at a relatively low flow rate to said bladder to expand said bladder to form the body in the die cavity, in response to the closing of the platens;

and including moving the platens through said initial and subsequent portions of their closing motion at a substantially constant speed.

2. The method of claim 1 wherein the volume of hydraulic fluid delivered to the bladder by the hydraulic pressure generator per unit length of travel of the platens as the platens move during the initial portion of the platen closing motion is greater than during the subsequent portion of the platen closing motion.

3. The method of claim 1 further comprising delivering hydraulic fluid from the hydraulic pressure generator to a fluid reservoir at a relatively low pressure level during said subsequent portion of the closing motion of the platens.

4. The method of claim 1 wherein said relatively high hydraulic pressure level is about 6–12 times higher than said relatively low hydraulic pressure level.

5. The method of claim 1 wherein the press platens are opened to effect the release of hydraulic pressure from said bladder to contract it so as to permit the removal of the cartridge case from said die cavity.

* * * * *